US005758242A

United States Patent [19]

Malespin et al.

[11] Patent Number: 5,758,242

[45] Date of Patent: May 26, 1998

[54] INTERLOCKING MAGNETIC DEVELOPER ROLL ASSEMBLY AND METHOD OF MANUFACTURING

[75] Inventors: Rafael Malespin, Rochester; Alan M. Litman, Webster, both of N.Y.

[73] Assignee: Xerox Corporation, Stamford, Conn.

[21] Appl. No.: 717,948

[22] Filed: Sep. 23, 1996

[51] Int. Cl.[6] ..... G03G 13/09

[52] U.S. Cl. ..... 399/277; 399/267; 492/38; 492/45

[58] Field of Search ..... 399/277, 267; 29/895.21; 492/8, 38, 45

[56] References Cited

U.S. PATENT DOCUMENTS

| | | | |
|---|---|---|---|
| 696,416 | 4/1902 | Denegre . | |
| 4,557,582 | 12/1985 | Kan et al. | 355/276 |
| 4,604,042 | 8/1986 | Tanigawa et al. | 425/3 |
| 4,823,102 | 4/1989 | Cherian et al. | 335/306 |
| 4,872,418 | 10/1989 | Yoshikawa et al. | 399/277 |
| 5,019,796 | 5/1991 | Lee et al. | 335/302 |
| 5,030,937 | 7/1991 | Loubier et al. | 399/279 X |
| 5,384,957 | 1/1995 | Mohri et al. | 29/895.32 |
| 5,453,224 | 9/1995 | Kuroda | 264/427 |

FOREIGN PATENT DOCUMENTS

| | | | |
|---|---|---|---|
| 219099 | 2/1910 | Germany | 492/38 |
| 308069 | 9/1918 | Germany | 492/38 |
| 352688 | 9/1922 | Germany | 492/38 |
| 62-277705 | 12/1987 | Japan . | |
| 63-34095 | 2/1988 | Japan . | |

*Primary Examiner*—Nestor R. Ramirez
*Attorney, Agent, or Firm*—John S. Wagley

[57] ABSTRACT

A developer roll for use in an electrophotographic printing machine of the type having an electrostatic latent image recorded on a photoconductive member in which a magnetic field attracts magnetic particles to form a magnetic brush on the periphery of a developer roll assembly. The developer roll assembly includes a sleeve and the developer roll. The developer roll is located at least partially within the sleeve. The developer roll includes a core having a core feature and a magnetic member having a member feature. The core feature and the member feature cooperate with each other so that the member and the core are mechanically interlocked with each other.

30 Claims, 7 Drawing Sheets

FIG. 5
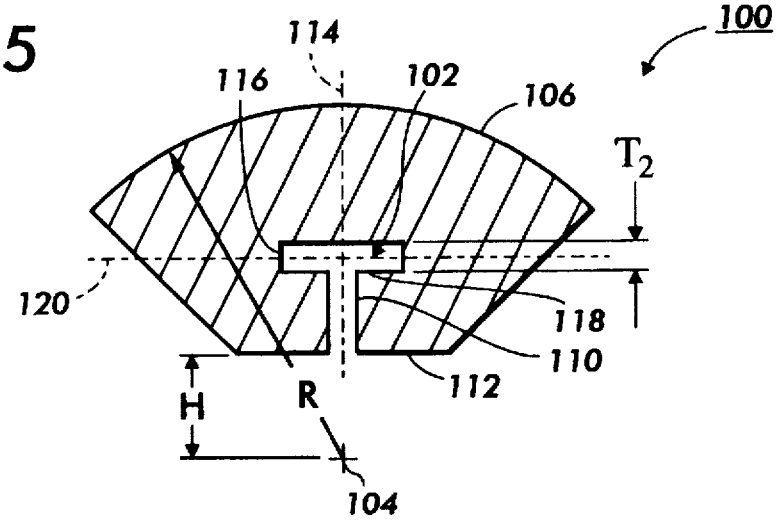
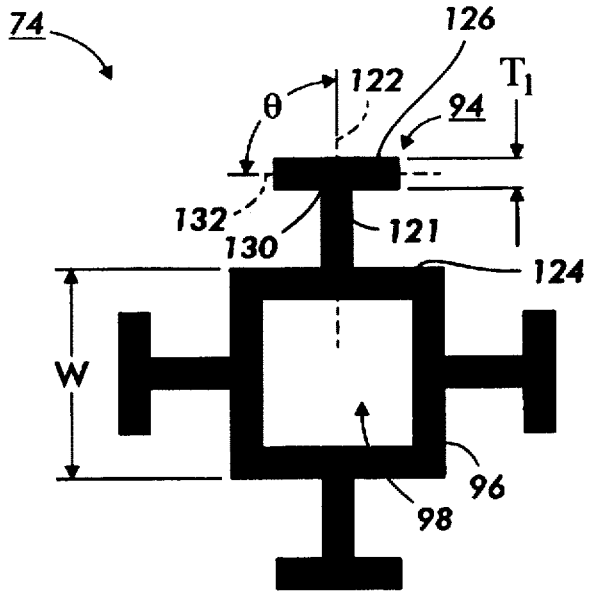
FIG. 6

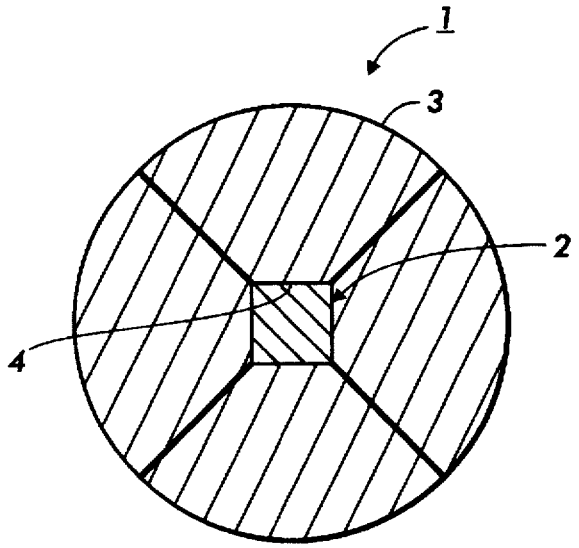
FIG. 7
PRIOR ART
FIG. 8
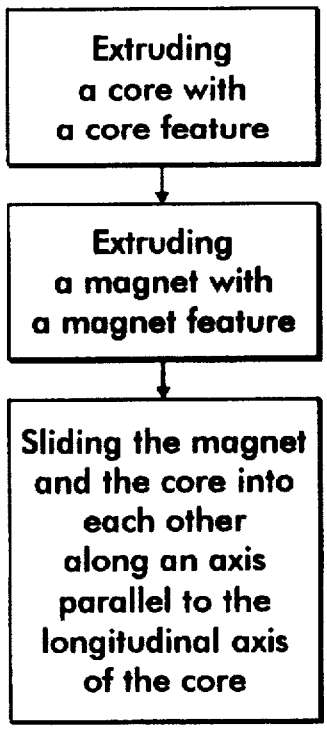

INTERLOCKING MAGNETIC DEVELOPER ROLL ASSEMBLY AND METHOD OF MANUFACTURING

The present invention relates to a method and apparatus for developing a latent image. More specifically, the invention relates to a magnetic developer roll for development systems.

The features of the present invention are useful in the printing arts and more particularly in electrophotographic printing. In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

The developer roll is typically in the form of a cylindrical sleeve rotating around an assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor).

Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

As stated earlier, development is typically accomplished by the use of a magnetic brush. The magnetic brush is typically formed by a developer roll which is typically in the form of a cylindrical sleeve which rotates around a fixed assembly of permanent magnets. When utilizing magnetic brush-type development, the cylindrical sleeve is typically made of an electrically conductive, non-ferrous material, for example, aluminum.

A prior art permanent magnet assembly 1 is shown in cross-section in FIG. 7. The permanent magnet assembly 1 includes a centrally located shaft 2 which extends the length of the assembly 1. The shaft 2 may have any suitable cross-section, for example, include a square cross-section, as shown in FIG. 7. Magnetic segments 3 are positioned about the centrally located shaft 2. The segments 3 may include four equally spaced and similarly shaped magnetic segments 3 having a surface core which is in contact with the centrally located shaft 2. The shaft 2 is typically made of steel while the permanently magnetic segments 3 are made of any suitable permanent magnetic. The segments 3 are secured to the shaft 2 by applying an adhesive between the surface 4 and the shaft 2. The adhesive is applied to either the shaft or the surface and physically positioned on the shaft 2.

The manual setting of the segments 3 about the shaft 2 results in a timely consuming process. Further, the manual setting of the segments and manually positioning thereof represents major quality problems with regard to the integrity of the gluing process as well as the positioning of the segments about the shaft 2. Such quality problems may require extra machining of the periphery of the segments. Further, the adhesive required to secure the segments to the shaft may cause contamination within the developer housing. Further, the adhesives may require special handling to conform to environmental and safety standards. Further, when the magnetic assembly 1 is remanufactured, the disassembly of the segments from the shaft may be difficult. Further, the residual glue on the shaft and segments may be difficult to remove and to dispose. The subject invention is intended to alleviate at least some of the aforementioned problems with the prior art.

The following disclosures may be relevant to various aspects of the present invention:

U.S. Pat. No. 5,453,224
Patentee: Kuroda
Issue Date: Sep. 26,1995
U.S. Pat. No. 5,384,957
Patentee: Mohri et al.
Issue Date: Jan. 31, 1995
U.S. Pat. No. 5,019,796
Patentee: Lee et al.
Issue Date: May 28, 1991
U.S. Pat. No. 4,872,418
Patentee: Yoshikawa et al.
Issue Date: Oct. 10,1989
U.S. Pat. No. 4,823,102
Patentee: Cherian et al.
Issue Date: Apr. 18, 1989
U.S. Pat. No. 4,604,042
Patentee: Tanigawa et al.
Issue Date: Aug. 5, 1986
U.S. Pat. No. 4,557,582
Patentee: Kan et al.
Issue Date: Dec. 10, 1985

U.S. Pat. No. 5,453,471 discloses a hollow member which serves as a cylinder having an inner configuration which matches the outer configuration of a magnet roller to be manufactured. The member is mounted in a metallic mold and then the metallic mold is clamped. A molten resin containing magnetic particles is injected into the mold cavity of the hollow member through a runner.

U.S. Pat. No. 5,384,957 discloses a method of producing a magnet roll in which a magnetic property comparable to that obtained by injection molding can be obtained in spite of an extrusion process. According to a first embodiment, the yoke width of the magnetic field extrusion die is varied along an extrusion direction. According to a second embodiment, a pipe filled with resin bonded magnet material is used as a shaft.

U.S. Pat. No. 5,019,796 discloses an improved bar magnet and method of construction and an improved magnetic core. An assembly of magnet is shown for use in a processing station of a printing machine. The bar magnet is formed of permanent magnet material having magnetic domains therein that are magnetized along epicyclical curve segments. The external magnetic flux density is improved over that of a conventionally magnetized magnet.

U.S. Pat. No. 4,872,418 discloses a magnet roll including a main body portion of a soft material and having a surface portion which is permanently magnetized. The roll also has a supporting portion integrally formed with the main body portion by the same soft materials as that of the main body portion for mounting the body portion to a member to which the main body is to be mounted.

U.S. Pat. No. 4,823,102 discloses a magnetic roll which is used in a processing station of a printing machine. The roll has a central portion with a plurality of spaced fins extending generally radially therefrom. A shaft extends outwardly from opposed ends of the central portion along the longitudinal axis thereof. A magnet is secured in each space between adjacent fins. A sleeve is rotatably supported on the shaft.

U.S. Pat. No. 4,604,042 discloses a mold for producing an anisotrophic magnet from a composition consisting essentially of magnetic powder and a binder. The mold includes a mold body, a cavity for molding the composition, yokes and first and second magnets on both sides of the yokes for preventing leakage of the magnetic field.

U.S. Pat. No. 4,557,582 discloses a magnet roll including magnet pieces adhesively secured to a supporting shaft to increase the magnetic flux density of a pole. The pieces are disposed so that they have repelling magnetic forces in the interface between the piece which has the pole and the piece adjacent thereto.

In accordance with one aspect of the present invention, there is provided developer roll for use in an electrophotographic printing machine of the type having an electrostatic latent image recorded on a photoconductive member in which a magnetic field attracts magnetic particles to form a magnetic brush on the periphery of a developer roll assembly. The developer roll assembly includes a sleeve and the developer roll. The developer roll is located at least partially within the sleeve. The developer roll includes a core having a core feature and a magnetic member having a member feature. The core feature and the member feature cooperate with each other so that the member and the core are mechanically interlocked with each other.

In accordance with another aspect of the present invention, there is provided a developer unit for use in an electrophotographic printing machine of the type having an electrostatic latent image recorded on a photoconductive member. The developer unit includes a housing defining a chamber for storing a supply of toner particles therein and a developer roll assembly for transporting the toner particles on a surface of the assembly from the chamber of the housing to the member. The developer roll assembly has a sleeve and a developer roll located at least partially within the sleeve. The developer roll includes a core having a core feature and a magnetic member having a member feature. The core feature and the member feature cooperate with each other so that the member and the core are mechanically interlocked with each other.

In accordance with yet another aspect of the present invention, there is provided an electrographic printing machine of the type having an electrostatic latent image recorded on a photoconductive member. The printing machine includes a housing defining a chamber for storing a supply of toner particles therein and a developer roll assembly for transporting the toner particles on a surface of the assembly from the chamber of the housing to the member. The developer roll assembly has a sleeve and a developer roll located at least partially within the sleeve. The developer roll includes a core having a core feature and a magnetic member having a member feature. The core feature and the member feature cooperate with each other so that the member and the core are mechanically interlocked with each other.

In accordance with a further aspect of the present invention, there is provided a method for manufacturing a developer roll for use in an electrophotographic printing machine of the type having an electrostatic latent image recorded on a photoconductive member. The method includes the steps of providing a core having a core feature, providing a magnet having a magnet feature, and assembling the core to the magnet by interconnecting the core feature and the magnet feature to each other.

BRIEF DESCRIPTION OF THE DRAWINGS

The invention will be described in detail herein with reference to the following figures in which like reference numerals denote like elements and wherein:

FIG. 5 is an enlarged sectional view of a magnetic segment for use in the interlocking developer roll of FIG. 1;

FIG. 6 is an enlarged sectional view of a core for use in the interlocking developer roll of FIG. 1;

FIG. 7 is a sectional view of a prior art developer roll;

FIG. 8 is a block diagram of a process for manufacturing the developer roll of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 3:
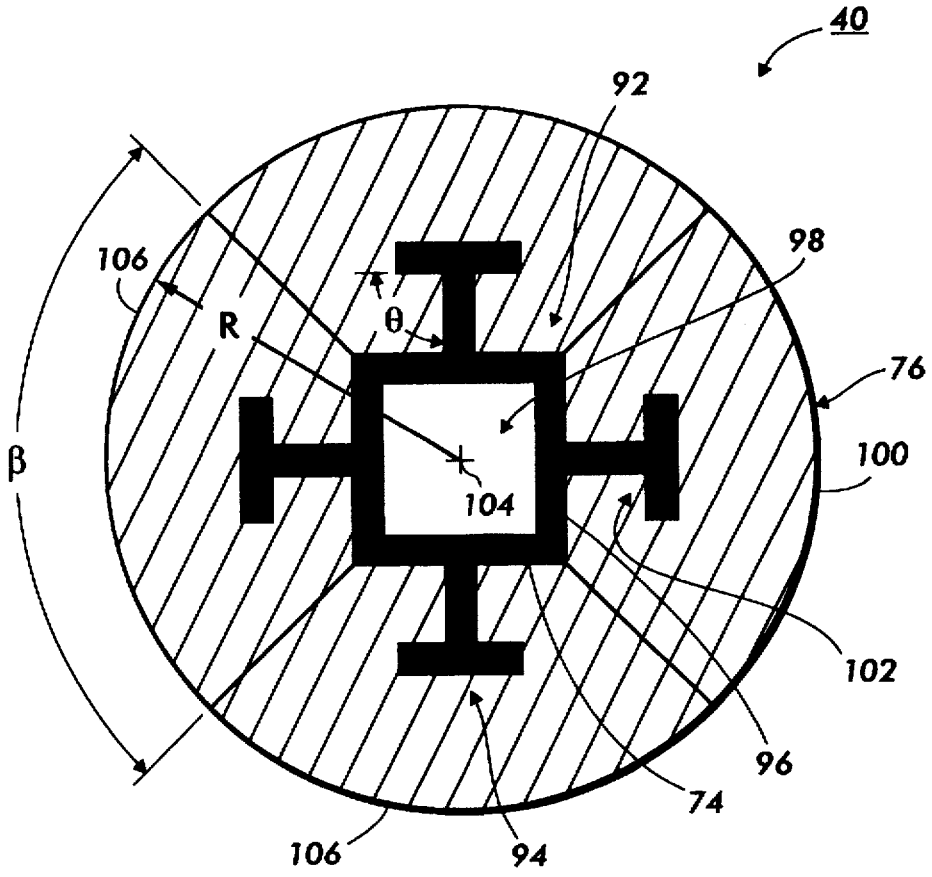
FIG. 3 is a sectional view along the line 3—3 in the direction of the arrows of the interlocking magnetic developer roll assembly of FIG. 1.

For a general understanding of the illustrative electrophotographic printing machine incorporating the features of the present invention therein, reference is made to the drawings. In the drawings, like reference numerals have been used throughout to designate identical elements. FIG. 3 schematically depicts the various components of an electrophotographic printing machine incorporating the developing device of the present invention therein. Although the developing device of the present invention is particularly well adapted for use in the illustrative printing machine, it will become evident that the developing device is equally well suited for use in a wide variety of printing machines and are not necessarily limited in its application to the particular embodiment shown herein.

Figure 2:
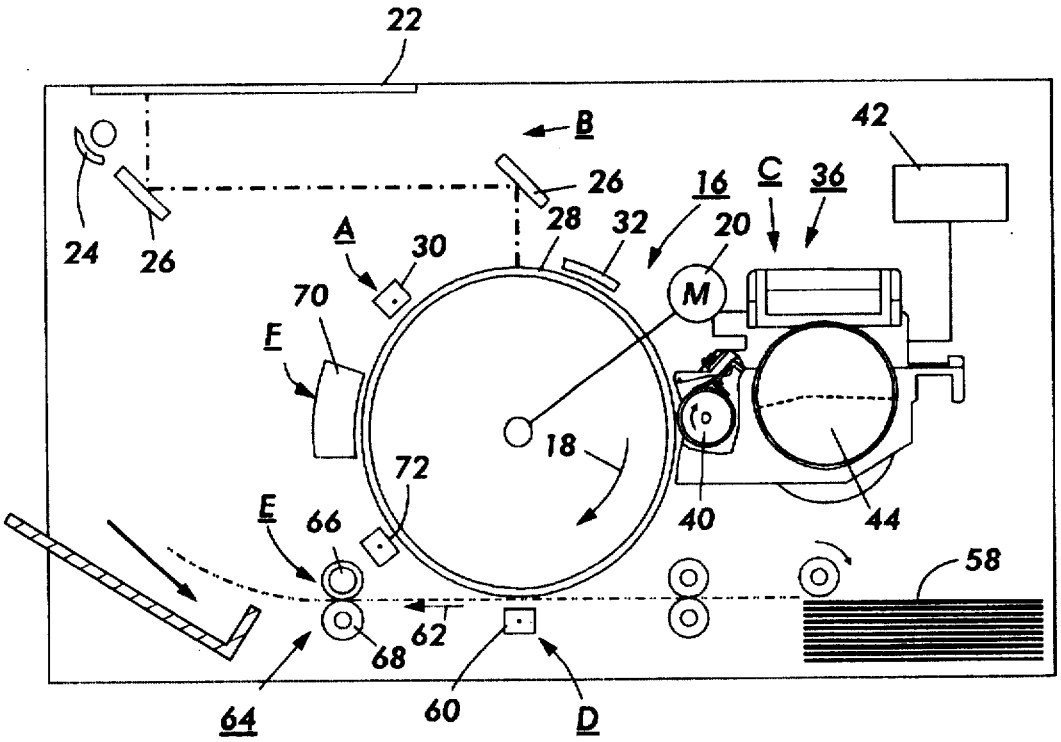
FIG. 2 is a schematic elevational view of an illustrative electrophotographic printing machine incorporating the interlocking developer roll of the present invention therein.

Referring now to FIG. 2, the electrophotographic printing machine shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof. Motor 20 rotates drum 16 to advance drum 16 the direction of arrow 18. Drum 16 is coupled to motor 20 by suitable means such as a drive.

Initially successive portions of drum 16 pass through charging station A. At charging station A, a corona generating device, indicated generally by the reference numeral 30, charges the drum 16 to a selectively high uniform electrical potential, preferably negative. Any suitable control, well known in the art, may be employed for controlling the corona generating device 30.

A document to be reproduced is placed on a platen 22, located at imaging station B, where it is illuminated in known manner by a light source such as a tungsten halogen lamp 24. The document thus exposed is imaged onto the drum 16 by a system of mirrors 26, as shown. The optical image selectively discharges surface 28 of the drum 16 in an image configuration whereby an electrostatic latent image 32 of the original document is recorded on the drum 16 at the imaging station B.

At development station C, a magnetic development system or unit, indicated generally by the reference numeral 36 advances developer materials into contact with the electrostatic latent images. Preferably, the magnetic developer unit includes a magnetic developer roller mounted in a housing. Thus, developer unit 36 contains a magnetic roller 40. The roller 40 advances toner particles into contact with the latent image. Appropriate developer biasing may be accomplished via power supply 42, electrically connected to developer unit 36.

The developer unit 36 develops the charged image areas of the photoconductive surface. This developer unit contains magnetic black toner, for example, particles 44 which are charged by the electrostatic field existing between the photoconductive surface and the electrically biased developer roll in the developer unit. Power supply 42 electrically biases the magnetic roll 40.

A sheet of support material 58 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack copy sheets. Feed rolls rotate so as to advance the uppermost sheet from the stack into a chute which directs the advancing sheet of support material into contact with the photoconductive surface of drum 16 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 16, the residual toner particles carried by image and the non-image areas on the photoconductive surface are charged to a suitable polarity and level by a preclean charging device 72 to enable removal therefrom. These particles are removed at cleaning station F. The vacuum assisted, electrostatic, brush cleaner unit 70 is disposed at the cleaner station F. The cleaner unit has two brush rolls that rotate at relatively high speeds which creates mechanical forces that tend to sweep the residual toner particles into an air stream (provided by a vacuum source), and then into a waste container. Subsequent to cleaning, a discharge lamp or corona generating device (not shown) dissipates any residual electrostatic charge remaining prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
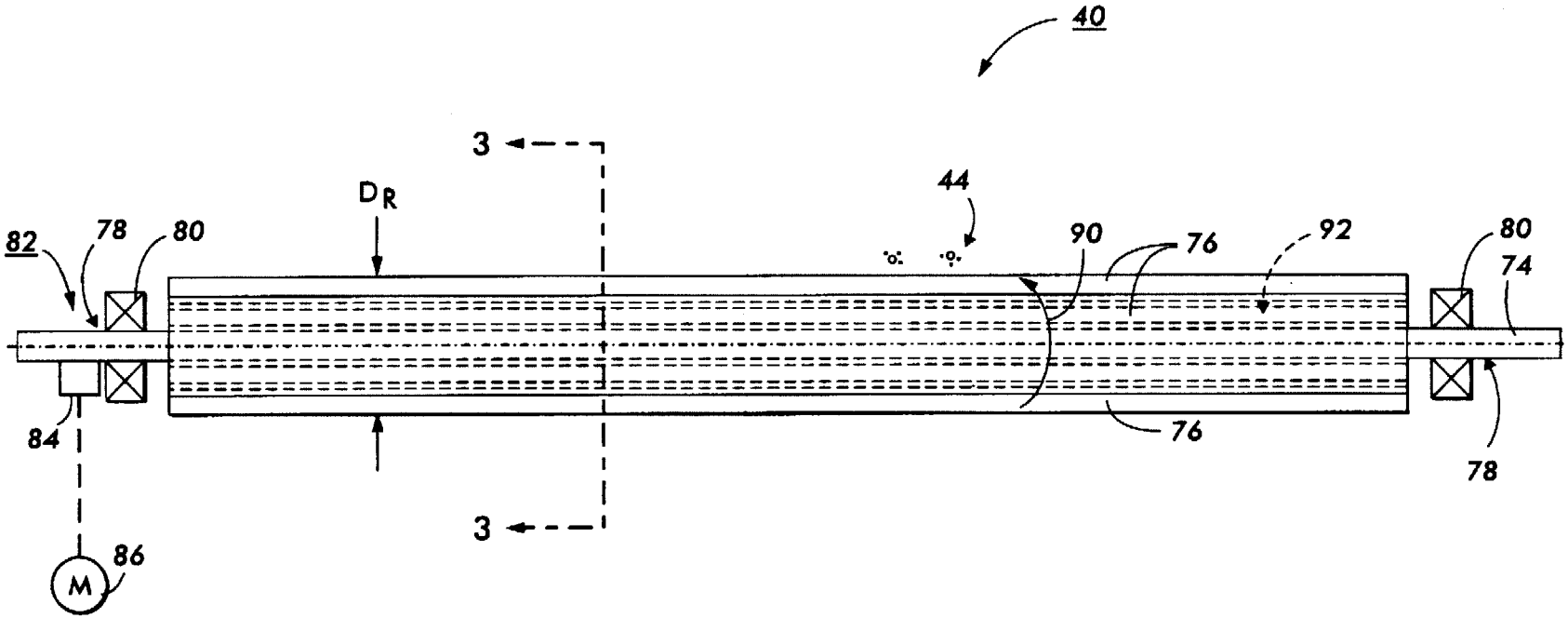
FIG. 1 is an elevational view of an interlocking magnetic developer roll according to the present invention.

According to the present invention referring to FIG. 1, the roll 40 in the form of interlocking magnetic developer roll assembly 40 is shown. The assembly 40 includes a core 74 about which a magnetic member 76 is secured. The core 74 may have any suitable shape and may for example be in the form of a shaft. The shaft 74 may include bearing portions 78 located within bearings 80 for supporting the developer magnetic assembly 40 which bearing portions are square and are fitted to bearings with square bores. Alternatively, the bearing portions 78 may have a circular cross-section. The core 74 may also include a drive portion 82 for connection with drive apparatus 84. The drive portion 82 may have preferably a non-circular cross-section to provide for the transfer of sufficient torque for operation with the drive apparatus 84. The drive apparatus 84 may include a power source, for example, motor 86 to cause the drive apparatus 84 to rotate the interlocking magnetic developer roll assembly 40 in the direction of rotation of arrow 90. The core 74 further includes magnetic support portion 92 for supporting magnetic member 76.

Figure 4:
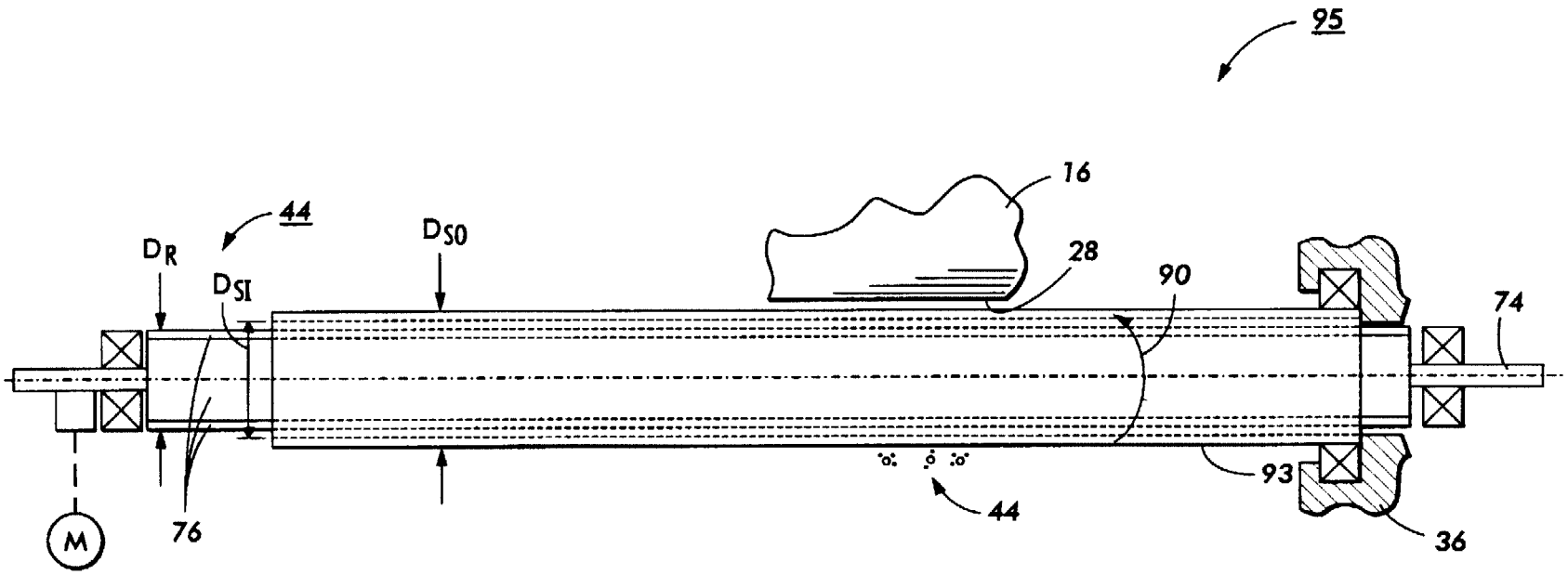
FIG. 4 is an elevational view of the interlocking developer roll of FIG. 1 assembled in a development sleeve.

Referring now to FIG. 4, the magnetic roll assembly 40 is shown assembled within sleeve or tube 93. The tube 93 may be made of any suitable durable magnetically non-conductive materials, for example, aluminum or plastic.

The tube 93 has a inner diameter $D_{SI}$ which is slightly larger than diameter $D_R$ of the magnetic roller 40. The tube 93 and the magnetic roller 40 serve to form an assembly 95. The assembly 95 may operate with a stationary tube 93 having a rotating magnetic roller 40 located therein or by having a rotating tube 93 rotating about a fixed magnetic roller 40. Preferably, however, as shown in FIG. 4, the tube 93 and the roller 40 both rotate, either in the same or opposed directions. The directions and angular velocities of the tube 93 and the roller 40 are so chosen so that the particles 44 progress on the periphery of the tube 93 toward the photoreceptive surface 28 of drum 16. The tube 93 is supported by bearings 97 mounted to the developer unit 36. The tube is driven by a power source (not shown) in the appropriate direction so as to advance the particles 44 as previously mentioned. The shaft 74 rotates in the direction of arrow 90 supported by bearings 80. The particles 44 thus advance in the direction of arrow 90 toward the photoreceptive surface 28 of drum 16.

Referring now to FIG. 3, the cross-section of the magnetic developer roll assembly 40 through the magnetic support portion 92 of the shaft 74 is shown. The shaft 74 includes a core feature 94 which preferably extends outwardly from base 96 of shaft 74. The base may have any suitable shape, for example, cylindrical, hexangular, triangular or rectangular, but as shown in FIG. 3 the base 96 may have a square cross-section. In order to minimize weight, the base 96 may include a central portion 98 which is hollow.

While the core feature 94 may be secured to the base 96 in any suitable fashion such as by fasteners or adhesives, preferably, the core feature 94 is integral with the base 96 of the shaft 74. To permit the shaft 74 to be manufactured as an extrusion, the shaft 74 has a uniform cross-section. The shaft 74, if molded, may either, as shown in FIG. 3, have a uniform cross-section, or have portions thereof with different cross-sections.

For example, referring again to FIG. 1, the core or shaft 74 may include the magnetic support portion 92 having the core features 94 thereon and also include bearing portions 78 having circular cross-sections as well as drive portion 84 having a square or other shape cross-section.

Referring again to FIG. 3, while the invention may be practiced with a magnetic member 76 having a solitary segment 100, the developer magnetic assembly 40 preferably includes a plurality of the segments 100. The segments 100 may be as shown in FIG. 3 identical to each other or, have unique shapes. Unique shapes of the segments 100 may be desirable if a non-uniform magnetic field is desirable within the developer unit 36 (see FIG. 2).

As shown in FIG. 3, the segments 100 include a member feature 102 which mates with the core feature 94 of the shaft 74. The segments 100 form an included angle Δ of approximately 90degrees when utilizing four of the segments 100 to form a circle or cylinder about the shaft 74. The segments 100 define radius R from centerline 104 of the segments 100 to periphery 106 of the segments 100.

While the core feature 96 and the member feature 102 may have any suitable mating configuration capable of interlocking the shaft 74 to the member 76, the applicants believe that the T-shaped configuration is particularly well suited for the invention.

Segments 100 utilizing the T-shaped member feature 102 of the present invention is shown in greater detail in FIG. 5. Member feature 102 includes a radial portion 110 extending perpendicularly from base 112 of the segments 100 along segment radial axis 114. The member feature 102 further includes a second portion 116 extending from second end 118 of the first portion of 110. Preferably the second portion 116 extends along perpendicular axis 120 perpendicular to the radial axis 114.

To improve the effectiveness of the interlock the second portion 116 extends in both directions from the first portion 110 of the member feature 102. The first portion 110 and the second portion 116 of the member feature 102 thereby form a T-shaped slot or opening in the segments 100 for connecting the core feature 94 of the shaft 74 thereto.

The segments 100 may be made of any suitable, durable, permanent magnetic material and may be made of a permanently magnetizable material as well. The segments 100 may be molded in an injection molding machine. Alternatively, segments 100 may be made by an extrusion process in an extrusion machine.

Referring now to FIG. 6, shaft 74 is shown in greater detail with a plurality of T-shaped core features 94. The core feature 94 includes a first portion 121 extending outwardly from base 96 along core feature radial axis 122 in a direction perpendicular to base face 124. The core feature 94 further includes a second portion 126 extending perpendicularly from second end 130 of the first portion 121 along perpendicular axis 132 perpendicular to axis 122.

The shaft 74 may be made of any suitable durable material, for example, a metal or a plastic material. To enhance the magnetic field and to direct the magnetic field appropriately it may be desirable to have the material of the shaft 74 to be a magnetizable material, for example, be made of ferrous metals. Likewise, the shaft 74 may be made of a material including carbon graphite materials capable of being magnetized.

Referring now to FIGS. 3, 5 and 6, the periphery 106 of the segments 100 may be accurately controlled to provide for a high quality interlocking magnetic developer roll assembly 40. To accurately control the periphery 106, the radius R of the segments 100 as well as a distance H from base 112 to centerline 104 may be accurately controlled. Further, the shaft 74 may be accurately controlled by controlling dimension W across the base face 124 of the base 96 of the shaft 74. If the dimensions, $R_1$, H and W, are sufficiently accurately controlled the periphery 106 of the segments 100 may not require further machining.

The segments 100 may be secured to the shaft 74 by sliding the segments 100 into the core feature 94 of the shaft 74 in a direction parallel to the longitudinal axis 104 of the core 74. To prevent the segments 100 from sliding off the shaft 7, endcaps (not shown) may be located on the ends of the shaft 74. Conversely, the core feature 94 may be interferencely fitted to the member feature 102. For example, the second portion 126 of the shaft 74 may have a thickness $T_1$ greater than thickness $T_2$ of the second portion 116 of the member feature 102. The segments 100 may then be assembled onto the shaft 74 by pressing the parts together on an arbor press, by freezing the shaft 74, by heating the segments 100, or by any combinations thereof.

Figure 9:
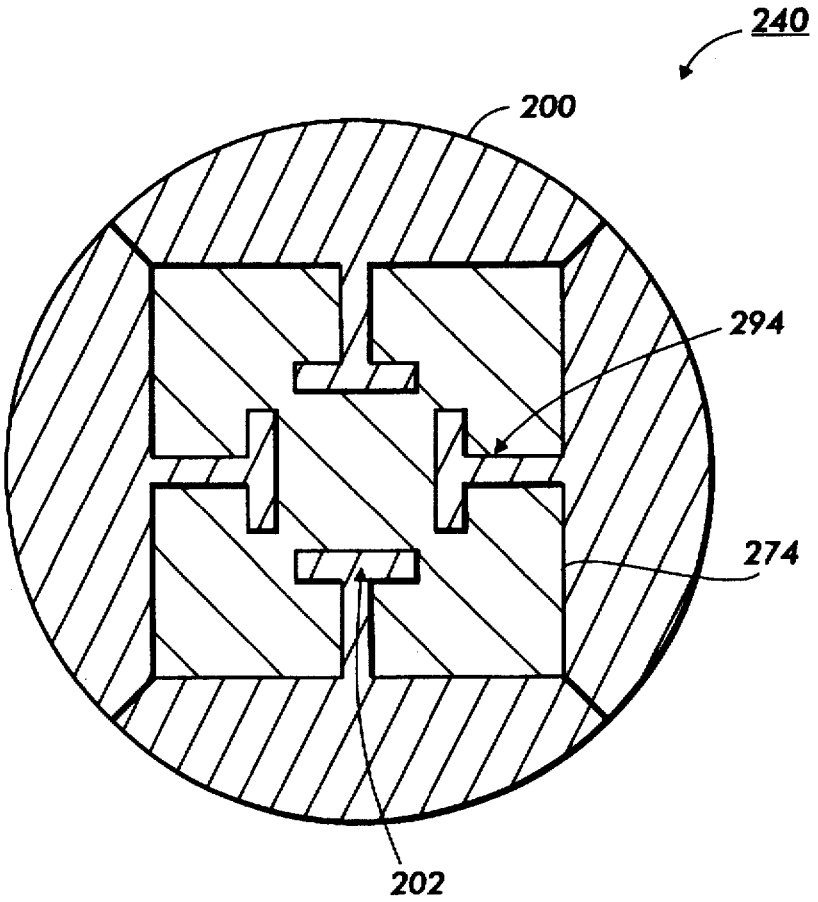
FIG. 9 is a sectional view of an alternate embodiment of the interlocking magnetic developer roll according to the present invention.

Referring now to FIG. 9, an alternate embodiment of the present invention in interlocking developer magnetic roll assembly 240. The interlocking developer magnetic roll assembly 240 includes shaft 274. Shaft 274 is similar to shaft 74 of the FIG. 3 magnetic roll assembly 40 except that shaft 274 includes shaft feature 294 in the form of an aperture. Interlocking developer magnetic roll assembly 240 further includes segments 200 which are similar to segments 100 of the FIG. 3 magnetic roll assembly except that segments 200 include magnetic member protrusions 202 which are matingly fitted to shaft apertures 294.

The interlocking developer magnetic assembly 40 may be made by any suitable process capable of making the segments 100 and the shaft or core 74. For example, referring now to FIG. 8, the core 74 may be manufactured by extruding a core having an integral core feature. The segments 100 may be made by extruding a magnetic material with a magnet feature. The segments 100 may be assembled onto the core 74 to form the interlocking magnetic developer assembly by sliding the segments 100 and the core 74 into each other along an axis parallel to the longitudinal axis of the core.

By providing a magnetic developer roll assembly with an interlocking feature, a magnetic developer roll assembly may be manufactured without the requirement of an adhesive.

By providing an interlocking magnetic developer roll assembly, a magnetic roll assembly can be provided with improved dimensional characteristics.

By providing an interlocking developer roll assembly with accurately positioned surfaces, a magnetic developer roll assembly may be provided which precludes the need of machining the periphery of the magnetic assembly.

By providing an interlocking developer assembly with T-shaped protrusions which mate with T-shaped slots, a simple interlocking system may be provided which may be made from extruded materials.

By providing an interlocking magnetic developer roll assembly having a T-shaped interlock, a core and segments may be molded from the similar materials and assembled together.

By providing an interlocking magnetic developer roll assembly with a core having a first interlocking feature and a magnetic having a second interlocking feature with the interlocking features being interferencely fitted, a developer roll assembly may be provided which is adequately secured without an adhesive.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A developer roll for use in an electrophotographic printing machine of the type having an electrostatic latent image recorded on a photoconductive member in which a magnetic field attracts magnetic particles to form a magnetic brush on the periphery of a developer roll assembly, the developer roll assembly including a sleeve and the developer roll located at least partially within the sleeve, said developer roll comprising:

a core including a core feature associated therewith, said core defining a longitudinal axis thereof, said core having a uniform cross section in the direction of the longitudinal axis of said core, said core having a single-piece construction; and a magnetic member including a member feature associated therewith, said core feature and said member feature interlocking with each other, said magnetic member defining a longitudinal axis thereof, said member having a uniform cross section in the direction of the longitudinal axis of said member so that said member may be assembled onto said core by sliding said member into said core in a direction parallel to the longitudinal axis of said core and so that said member and said core are mechanically interlocked with each other.

2. The developer roll as in claim 1, wherein:

said member feature is integral with said member and said core feature is integral with said core.

3. The developer roll as in claim 1, wherein:

said core feature comprises a protrusion extending from said core; and said member defines an aperture, the aperture defining the member feature.

4. The developer roll as in claim 3, wherein said protrusion comprises:

a first portion extending outwardly from said core; and a second portion extending from said first portion, said second portion defining a lip to mechanically interlock said protrusion with said magnetic member.

5. The developer roll as in claim 3, further comprising:

a second protrusion extending from said base; and a second magnetic member at least partially surrounding the second protrusion.

6. The developer roll as in claim 5, wherein at least one of said first mentioned protrusion and said second protrusion comprise:

a first portion extending substantially radially outward from said base; and a second portion extending perpendicularly from said first portion, said second portion defining a lip to mechanically interlock said protrusion with said magnetic member.

7. The developer roll as in claim 6, wherein said second portion extends perpendicularly from said first portion in two opposed directions, said second portion defining said first mentioned lip and a second lip to mechanically interlock said protrusion with said magnetic member.

8. The developer roll as in claim 1, wherein;

said core feature and said member feature are interferencely fitted to each other.

9. The developer roll as in claim 1, wherein:

said member feature comprises a protrusion extending from said member; and said core defines an aperture, the aperture defining the core feature.

10. A developer unit for use in an electrophotographic printing machine of the type having an electrostatic latent image recorded on a photoconductive member, the developer unit comprising:

a housing defining a chamber for storing a supply of toner particles therein; and a developer roll assembly for transporting the toner particles on a surface thereof from the chamber of the housing to the member, said developer roll assembly having a sleeve and a developer roll located at least partially within the sleeve, said developer roll including a core having a core feature associated therewith, said core defining a longitudinal axis thereof, said core having a uniform cross section in the direction of the longitudinal axis of said core, said core having a single-piece construction, and a magnetic member having a member feature associated therewith, said magnetic member defining a longitudinal axis thereof, said member having a uniform cross section in the direction of the longitudinal axis of said member so that said member may be assembled onto said core by sliding said member into said core in a direction parallel to the longitudinal axis of said core and said core feature and said member feature interlocking with each other so that said member and said core are mechanically interlocked with each other.

11. The developer unit as in claim 10, wherein:

said member feature is integral with said member and said core feature is integral with said core.

12. The developer unit as in claim 10, wherein:

said core feature comprises a protrusion extending from said core; and said member defines an aperture, the aperture defining the member feature.

13. The developer unit as in claim 12, wherein said protrusion comprises:

a first portion extending outwardly from said core; and a second portion extending from said first portion, said second portion defining a lip to mechanically interlock said protrusion with said magnetic member.

14. The developer unit as in claim 12, further comprising:

a second protrusion extending from said base; and a second magnetic member at least partially surrounding the second protrusion.

15. The developer unit as in claim 14, wherein at least one of said first mentioned protrusion and said second protrusion comprise:

a first portion extending substantially radially outward from said base; and a second portion extending perpendicularly from said first portion, said second portion defining a lip to mechanically interlock said protrusion with said magnetic member.

16. The developer unit as in claim 15, wherein said second portion extends perpendicularly from said first portion in two opposed directions, said second portion defining said first mentioned lip and a second lip to mechanically interlock said protrusion with said magnetic member.

17. The developer unit as in claim 10, wherein;

said core feature and said member feature are interferencely fitted to each other.

18. The developer unit as in claim 10, wherein:

said member feature comprises a protrusion extending from said member; and said core defines an aperture, the aperture defining the core feature.

19. An electrophotographic printing machine of the type having an electrostatic latent image recorded on a photoconductive member, the printing machine comprising:

a housing defining a chamber for storing a supply of toner particles therein; and a developer roll assembly for transporting the toner particles on a surface thereof from the chamber of the housing to the member, said developer roll assembly having a sleeve and a developer roll located at least partially within the sleeve, said developer roll including a core having a core feature associated therewith, said core defining a longitudinal axis thereof, said core having a uniform cross section in the direction of the longitudinal axis of said core, said core having a single-piece construction, and a magnetic member having a member feature associated therewith, said magnetic member defining a longitudinal axis thereof, said member having a uniform cross section in the direction of the longitudinal axis of said member so that said member may be assembled onto said core by sliding said member into said core in a direction parallel to the longitudinal axis of said core and said core feature and said member feature interlocking with each other so that said member and said core are mechanically interlocked with each other.

20. The printing machine as in claim 19, wherein:

said member feature is integral with said member and said core feature is integral with said core.

21. The printing machine as in claim 19, wherein:

said core feature comprises a protrusion extending from said core; and said member defines an aperture, the aperture defining the member feature.

22. The printing machine as in claim 21, wherein said protrusion comprises:

a first portion extending outwardly from said core; and a second portion extending from said first portion, said second portion defining a lip to mechanically interlock said protrusion with said magnetic member.

23. The printing machine as in claim 21, further comprising:

a second protrusion extending from said base; and a second magnetic member at least partially surrounding the second protrusion.

24. The printing machine as in claim 23, wherein at least one of said first mentioned protrusion and said second protrusion comprise:

a first portion extending substantially radially outward from said base; and a second portion extending perpendicularly from said first portion, said second portion defining a lip to mechanically interlock said protrusion with said magnetic member.

25. The printing machine as in claim 24, wherein said second portion extends perpendicularly from said first portion in two opposed directions, said second portion defining said first mentioned lip and a second lip to mechanically interlock said protrusion with said magnetic member, a core having a base and a protrusion extending therefrom and a magnetic member at least partially surrounding the protrusion so that said member is mechanically interlocked with said core.

26. The printing machine as in claim 19, wherein;

said core feature and said member feature are interferencely fitted to each other.

27. The printing machine as in claim 19, wherein:

said member feature comprises a protrusion extending from said member; and said core defines an aperture, the aperture defining the core feature.

28. A method for manufacturing a developer roll for use in an electrophotographic printing machine of the type having an electrostatic latent image recorded on a photoconductive member, said method comprising the steps of:

providing a core having a core feature and a single-piece construction;

providing a magnet having a magnet feature; and assembling the core to the magnet by interconnecting the core feature and the magnet feature to each other by sliding the magnet and the core into each other along an axis parallel the longitudinal axis of the core.

29. The method of claim 28, wherein the step of providing a core comprises extruding the core with the core feature.

30. The method of claim 29, wherein the step of providing a magnet comprises extruding the magnet with the magnet feature.

* * * * *